United States Patent [19]

Oppermann

[11] 4,419,373

[45] Dec. 6, 1983

[54] METHOD OF HEATING CONTENTS IN A SELF VENTING CONTAINER

[75] Inventor: Walter J. Oppermann, Neenah, Wis.

[73] Assignee: American Can Company, Greenwich, Conn.

[21] Appl. No.: 363,072

[22] Filed: Mar. 29, 1982

[51] Int. Cl.[3] ..... B65D 81/34

[52] U.S. Cl. ..... 426/234; 426/111; 426/113; 426/118; 426/127; 426/122; 426/412; 426/415; 426/395; 426/396; 426/411; 229/DIG. 14; 229/87 F

[58] Field of Search ..... 426/118, 111, 412, 113, 426/415, 114, 107, 234, 243, 395, 127; 229/DIG. 14, 87 F; 53/440

[56] References Cited

U.S. PATENT DOCUMENTS

| | | | |
|---|---|---|---|
| 2,633,284 | 3/1953 | Moffett et al. | 426/118 |
| 2,674,536 | 4/1954 | Fisher | 426/114 |
| 3,323,442 | 6/1967 | Rader | 229/DIG. 14 |
| 3,398,041 | 8/1968 | Ferree | 426/114 |
| 3,399,822 | 9/1968 | Kugler | 229/DIG. 14 |
| 3,410,697 | 11/1968 | Stephenson | 426/114 |
| 3,432,087 | 3/1969 | Costello | 426/118 |
| 3,672,916 | 6/1972 | Virnig | 426/114 |
| 3,949,114 | 4/1976 | Viola et al. | 426/412 |
| 3,949,934 | 4/1976 | Goglio | 426/118 |
| 3,969,535 | 7/1976 | Bourns | 426/111 |
| 3,997,677 | 12/1976 | Hirsch et al. | 426/118 |
| 4,013,798 | 3/1977 | Goltsos | 426/118 |
| 4,036,423 | 7/1977 | Gordon | 426/111 |
| 4,141,487 | 2/1979 | Faust et al. | 426/118 |
| 4,210,674 | 7/1980 | Mitchell | 426/118 |
| 4,247,563 | 1/1981 | Sample | 426/127 |
| 4,267,960 | 5/1981 | Lind et al. | 426/127 |
| 4,292,332 | 9/1981 | McHam | 426/118 |

FOREIGN PATENT DOCUMENTS

| | | | |
|---|---|---|---|
| 479968 | 1/1952 | Canada | 426/114 |

*Primary Examiner*—Steven L. Weinstein

*Attorney, Agent, or Firm*—Stuart S. Bowie; Thomas D. Wilhelm

[57] ABSTRACT

A sealed package, and a method of heating a sealed package of material are disclosed wherein the material is capable of generating vapor from a substance contained therein when the temperature of the material is raised. At least a portion of the packaging structure comprises a plastic film. Thermal energy is applied to the material causing the plastic film to be displaced by generated vapor. After the film is displaced, a vent hole appears in the film, venting the vapor without substantial rupture of the film.

9 Claims, 11 Drawing Figures

METHOD OF HEATING CONTENTS IN A SELF VENTING CONTAINER

BACKGROUND OF THE INVENTION

This invention relates to packages of material wherein the contained material includes a substance subject to vaporization when the material is heated. More particularly, the invention relates to the cooking of materials such as foods in microwave ovens, and specifically to the cooperative roles of the food and the container during the cooking process.

It is widely known that microwave ovens are especially well adapted for cooking of convenience-type foods which can be cooked in a short period of time with minimal work on the part of the cook. It is also widely known that, in the markets served by microwave cooking, a substantial value is attached to convenience and time. Thus, manufacturers of disposable food service items have successfully adapted their products and introduced them as disposable cooking containers for use with microwave ovens. A typical disposable container has a paperboard tray containing the food, with a film lid sealed over the top of the tray. Such a container is economical to manufacture. It readily contains and protects the food.

In typical applications the package is kept in refrigerated storage, and is put in the microwave oven while still frozen. As heat is generated in the food in the microwave oven, the vapor pressure inside the sealed package rises with the increase in temperature. As the vapor pressure rises, it is important that the evolving vapor (and eventually steam) be released from the package by some venting means; or else the vapor pressure inside the package increases to the point where the package bursts, the burst normally occurring in the film lid.

As a means of vapor release, some packagers suggest that the film lid should be loosened before the package is put in the oven. Others suggest puncturing the lid before putting it in the oven. Still others provide punctures in the lid and cover it with an overwrap which is to be removed before putting it in the oven. Common to all of these products is the fact that the sealed integrity of the package is penetrated before the package is put in the oven. In a more expensive solution, a one-way valve may be built into the package.

In one practical design, wherein an economical package may be put into the oven while still sealed, a self-venting film lid is disclosed in U.S. Pat. No. 4,210,674, of common assignment herein. In that case, a material sensitive to microwave energy is printed on the lid film; and the absorbed microwave energy melts vent holes in the film. The printing of the absorbing material, however, may not always be acceptable.

Thus it is desirable to provide an alternate method of venting a package which is placed in a microwave oven in a sealed condition.

SUMMARY OF THE INVENTION

It has now been found that a venting means may be provided in a package which is placed in a microwave oven in a sealed condition without use of materials specifically sensitive to absorption of microwave energy. The invention, in its broad interpretation, is exemplified in a package, and a method of heating a package of material wherein the material is contained therein when the temperature of the material is raised.

The material is first enclosed in a sealed packaging structure wherein at least a portion of the packaging structure comprises an extensible plastic film, at least a portion of the film having a route devoid of barriers between the film and the material. Before initiating the application of heat, the package is configured so that at least a portion of the film is devoid of barriers to displacement of the film away from the material. Thermal energy is then applied to the material, causing substantial vaporization of the substance, such that the plastic film is displaced by the vapor away from the material.

The film is selected such that, after the film is displaced from the material, a vent hole appears in the film for venting the vapor without substantial rupture of the film as a whole, and the film retains its general displaced configuration after appearance of the vent hole.

In the package described herein, the thermal energy is induced in the material by subjecting the package to microwave energy, such as is commonly used in microwave ovens. The material to be heated is most commonly a food containing water as the vaporizable substance.

It has been found that films suitable for use herein contain a major amount of ionomer, the film being between about 1 mil and 6 mils thick. In one preferred configuration, the film contains 10% EVOH, 10% Plexar and 80% ionomer, with the total film thickness being between 3 and 4 mils.

Another, and most preferred class of ionomer-based films is 3 mils to 4.5 mils thick, and is comprised of ionomer with a coating of Saran on one of its surfaces.

DETAILED DESCRIPTION OF THE INVENTION

Figure 1:
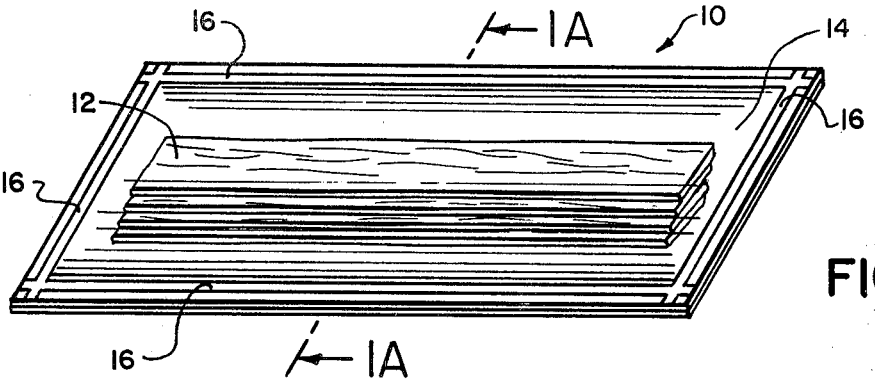
FIG. 1 shows a typical package for use in this invention, wherein bacon is enclosed and sealed in a film packaging material.

Referring now to the drawings in detail, FIG. 1 shows a package 10 of bacon, wherein slices of bacon 12 are arranged in shingled array within a sealed film packaging structure 14. The package 10 is sealed by heat seals 16 about its periphery.

Figure 1A:
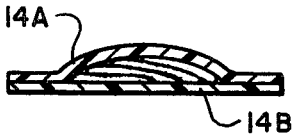
FIG. 1A is taken at 1A—1A of FIG. 1 and shows a cross-section of the package of FIG. 1.

In a common method of making the package, the bacon is placed on a bottom film 14B and a top extensible film 14A is placed over it, either as a separate film or as a folded over segment of the bottom film, to form a loose enclosure. See FIG. 1A. The enclosure is subjected to a vacuum system which withdraws residual air from the package, and the film edges are heat sealed together. In the completed package, as at 10 in FIG. 1, the periphery of the film edges is sealed at heat seals 16 against passage of gas into or out of the package, and in general, no air is left in the package after the vacuum removal during the packaging operation. The finished package is typically known as a sealed vacuum packaged unit.

In practice of this invention, the film selected to form the vent hole in the package has specific requirements regarding its performance when subjected simultaneously to heat and internal gaseous pressure, as will be disclosed in more detail hereinafter. The invention is best illustrated by use of conventional microwave ovens such as are readily available.

Figure 2:
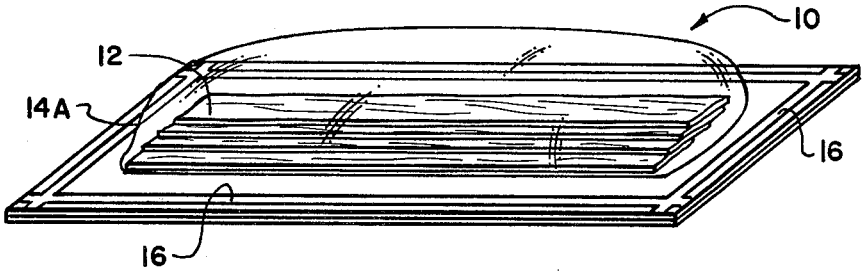
FIG. 2 shows the package of FIG. 1 with the film displaced in bubble form from the bacon by vapor generated during the initial stages of heating of the bacon.

Thus to illustrate the invention, the package 10 of FIG. 1 was placed in a microwave oven, not shown, and the oven energized in the normal manner for cooking bacon. As the bacon became warmed, and then hot, the vapor pressure in the water contained in the bacon increased in accord with accepted laws of vapor pressure physics. As the vapor pressure increased, and the film became warmed by the hot moisture vapors evolving from the bacon, the film was displaced, by the hot moisture vapor, away from the bacon; it is believed the displacement was a reaction to the softening effect of the heat of the vapor simultaneously with the increase in pressure of the vapor. FIG. 2 shows the package with the film in an intermediate stage of displacement.

Figure 3:
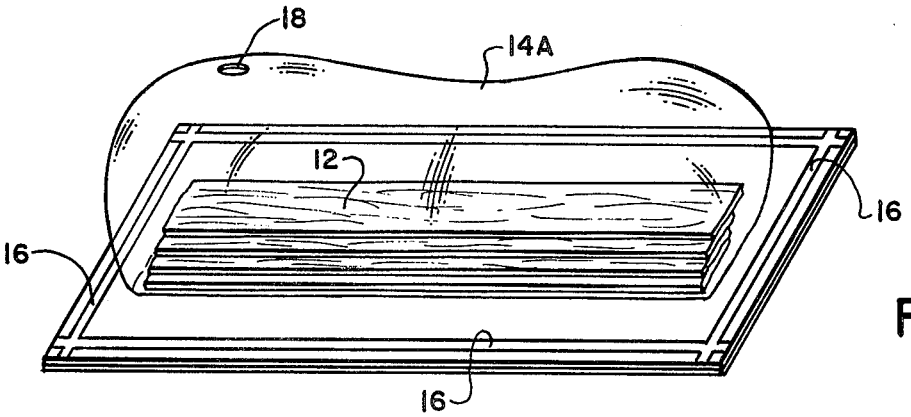
FIG. 3 shows the package of FIG. 1 with the film fully displaced and a vent hole in the film near the top of the bubble.

As the temperature and vapor pressure increased, the top film 14A was further displaced from the bacon, and reached a terminal stage of full displacement such as is shown in FIG. 3, at which point a vent hole 18 was formed in the film. Hole 18 acted functionally as a vent for release of the excess steam pressure, while the continuing evolution of vapors from the bacon kept the film displaced. An additional function of the top film 14A in its distended, displaced condition, as shown in FIG. 3, and to some extent FIG. 2, was that the film serves as a miniature enclosure, about the cooking food, of a gaseous cooking environment which is commonly practiced with the use of covered durable cooking vessels, such as metal or glass roasting pans and baking dishes when used with lid type covers. In such an environment, it is accepted that vapors evolve from the cooking food, condense on the lid, and return by gravity, in the form of liquid droplets, along the surface of the cover to the contents in the lower part of the cooking vessel. Thus the environment of the closed vessel is conducive to repetitious cycling of the liquid from the general body of the food into the vapor state, condensation onto the lid, and return to the general body of food. While there are numerous variations of this general method of cooking, common to them all is that the food is bathed in a saturated moist environment generally conducive to pleasing development of soft, moist, and delectable foods.

Thus the package in its fully displaced cooking stage, as in FIG. 3, has been converted from its flat, vacuum-packed appearance of an ordinary package as in FIG. 1 to a covered cooking vessel which functions as a cooking vessel in the same manner as a metal or glass cooking vessel.

Advantageously, of course, the packaging structure 14 is relatively inexpensive, and thus may be treated as a disposable item. This provides substantial convenience and time value to the user in that the food does not have to be transferred to another vessel for cooking. There is also no cooking vessel to be later washed. Further, the miniature environment created as at FIG. 3 is conducive to the desirable retention of the cooking juices.

Referring further to FIGS. 1–3, at the point the bacon is judged adequately cooked, the oven is turned off and the package is removed. When the oven is turned off, the film collapses upon the bacon. The film is readily torn away, exposing the ready-to-eat food.

It should be specifically noted that, during the cooking process, the package remained intact as an enclosing and protecting structure, generally preventing the ingress of contaminants from the outside environment. Even in the fully displaced condition as in FIG. 3, the essential protective nature of the package remained intact. The hole as at 18 served only as a means of escape of excessive pressure and vapors. The package was not subject to any sudden bursting or other sudden displacements which would disrupt the protective or containing nature of the packaging structure.

It should be further noted that hole 18 was self-generated at an unselected location in a generally continuous and uniform film which had no particular indentations, or other weakening formation therein for the purpose of generating the hole. The hole, rather, makes its appearance generally at the top of the displaced film at a location of its own choosing. Thus a uniform film may be used on the top of the package, without the film necessarily having any weakening pretreatments for the purpose of generating the hole, although such weakening pretreatments may in some cases be desirable.

Since the hole need appear in only one place, it is only necessary that a part of the packaging structure be formed of film material such as 14A which is susceptible of generating a hole as at 18. Thus, for example, the package in FIG. 1 may have only the top film 14A formed from the film material susceptible of generating the hole. The bottom layer 14B may be formed from any of a vareity of materials. Thus layer 14B could be a more rigid material, such as a thermoformable plastic, or other packaging material. It is important, however, that the entire packaging structure remain adequately sealed until completion of the cooking, with the exception of the vent hole, that adequate heat and pressure are exerted on the film to ensure the creation and functioning of hole 18.

It is further important that the film susceptible of generating a hole have a route devoid of barriers to gaseous movement between itself and the source of the vaporizable moisture which is generally located in the containing spacial portion of the package. For example, if the bacon in FIGS. 1–3 were first sealed in a non-extensible packaging material, and subsequently overwrapped with an extensible film so that the vapor could never get to the extensible film, the extensible film could not be acted on by the steam, and the characteristics of the non-extensible film would control. If, on the other hand, a passage is provided, in this hypothetical situation, through the non-extensible film, then the extensible film can be affected in the nrmal manner.

One further requirement is that at least a portion of the extensible film 14A be devoid of barriers to its displacement. Thus, if extensible film 14A were covered throughout its exterior package surface by a non-extensible material, such that movement of extensible film 14A was not allowed, then the film could not be displaced, and the hole would not form.

Figure 4:
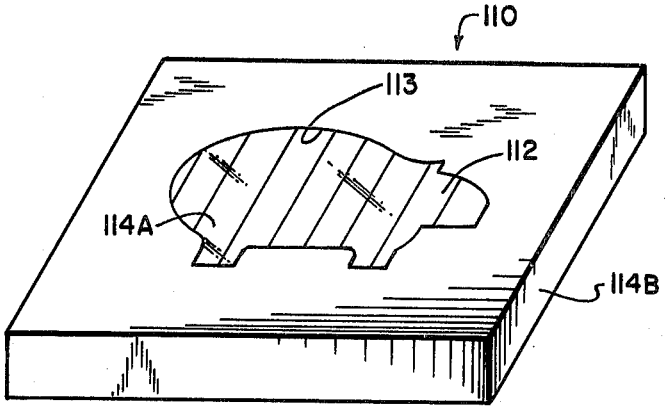
FIG. 4 shows an alternate package for use in this invention incorporating a paperboard carton in the package along with the film.
Figure 5:
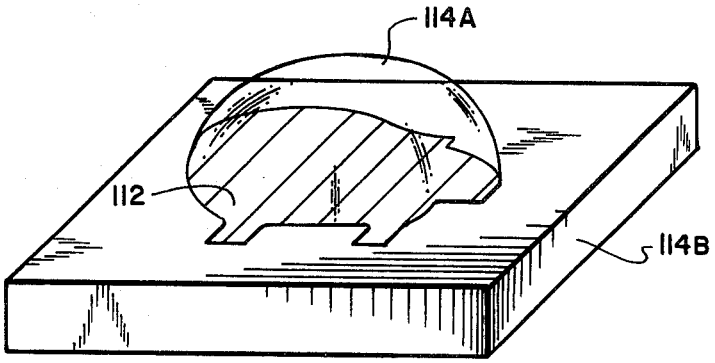
FIGS. 5 and 6 show the package of FIG. 4 at stages of intermediate and full displacement respectively, FIG. 6 showing the vent hole.
Figure 6:
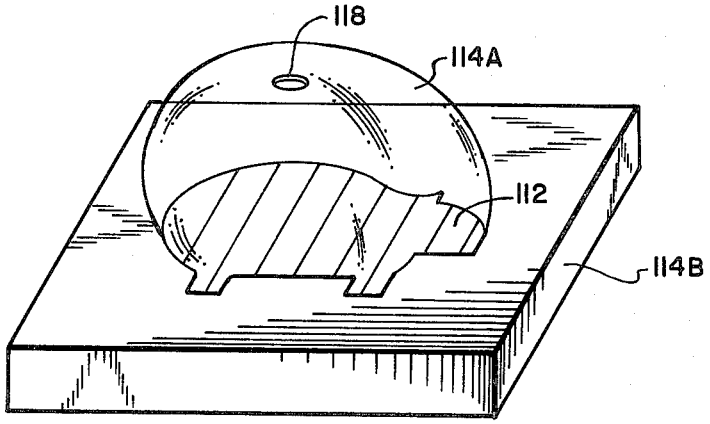
Figure 7:
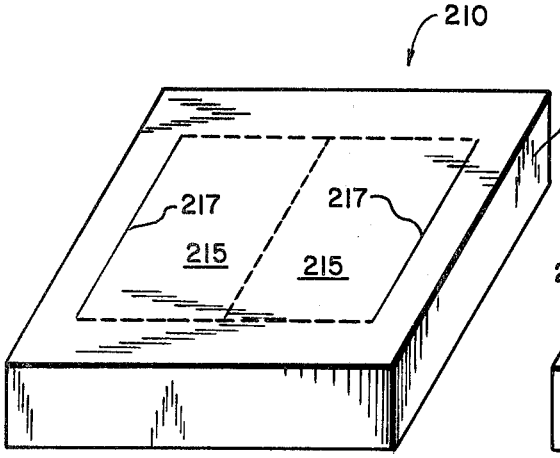
FIGS. 7–10 show yet another package for use with this invention wherein displaceable carton members initially cover the film.

An alternate version of the package for use in this invention is shown in FIGS. 4, 5, and 6, wherein the package 110 includes a sealed packaging structure comprising generally a paperboard carton 114B with a cutout 113 covered by film window 114A. When the food 112 in the package is heated, the film 114A is displaced as shown in FIGS. 5 and 6, the hole appearing in the top of the bubble as at 118 in FIG. 6.

Figure 8:
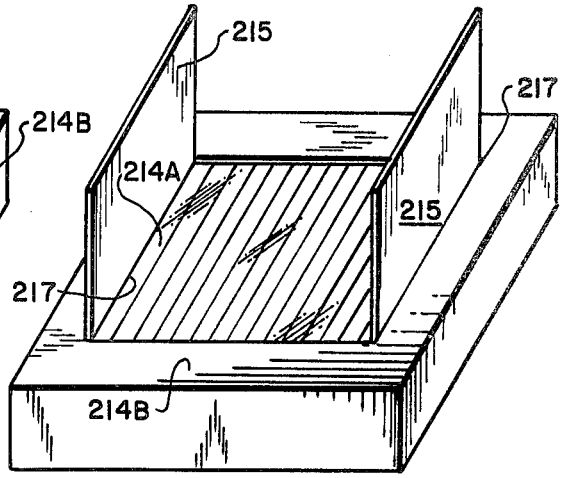
Figure 9:
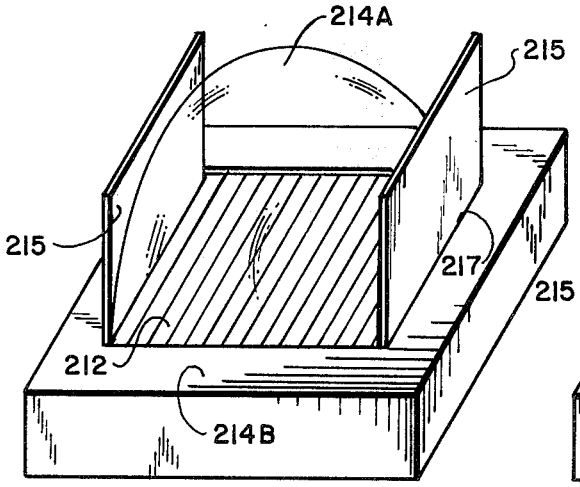
Figure 10:
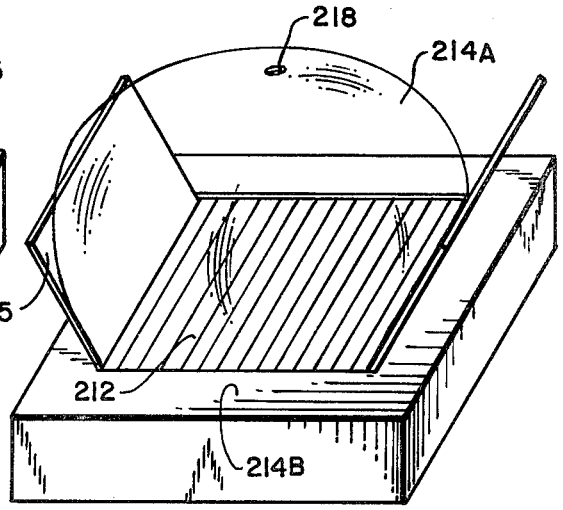

In still another version of the package as shown in FIGS. 7, 8, 9, and 10 the package 210 includes a sealed packaging structure comprising generally a paperboard carton 214B having openable window flaps 215 cut therein, and a film 214A underlying flaps 215 shown in FIG. 8. FIG. 8 shows the package with the flaps 215 open as for illustration of film 214A and for displacement of film 214A. As shown, flaps 215 are cut through the paperboard about their periphery with the exception of hinge lines 217, and possibly some retaining nicks. It is important that flaps 215 not function as barriers to displacement of the entire surface of film 214A. Thus they may be opened as at FIG. 8 before cooking is begun. If, however, hinge lines 217 are adequately weak, and retaining nicks are not used, then flaps 215 need not be opened before cooking, as the displacing film 214A will push them open and they will not functionally act as barriers. Thus it is to be understood that a barrier to displacement of the extensible film should not be defined in terms of its placement or its physical properties of rigidity. It should, rather be defined in terms of its functional properties as they relate to its impediment to displacement of the extensible film.

Films suitable for use as the extensible film, in packages of this invention are generally between 1 mil and 6 mils thick, and preferably between 3 mils and 4.5 mils thick. Films suitable for use in this invention are those having a high proportion, and preferably at least 8% by weight, of ionomer. Ionomer is conventionally available from the DuPont Company.

One extensible film found particularly advantageous for use in this invention is a film 4.5 mils thick having three layers respectively, by weight, from the inside of the package out, of 80% ionomer, 10% Plexar and 10% ethylene vinyl alcohol. Plexar is an anhydride modified ethylene-based polymer available from the Chemplex Company. The ethylene vinyl alcohol can be, for example, EP-F, containing 29% ethylene, and is available from Kuraray Company, Japan.

Another, and preferred, extensible film is 3 mils thick and is ionomer having a coating of Saran about 0.1 mil thick, Saran being a commonly used film coating material.

A further acceptable film is an uncoated ionomer film 4.5 mils thick.

Other films which were tested and found not acceptable include linear low density polyethylene, ethylene vinyl acetate and polypropylene copolymer. These are typical of films which extend into a bubble and then burst, causing substantial rupture of the film and accompanying disruption of the package.

The term extensible in its use in describing the film refers to the functional susceptibility of the film to being extensibly displaced when subjected to the cooking environment, and may or may not reflect extensible displacement properties of the film at other conditions.

It will be appreciated that, during the cooking process, moisture evolves from the food at generally increasing temperatures, so that the vapors are, at first, best described as hot moisture, and later are best described as steam. Thus both terms are used interchangeably herein in describing the evolving gaseous moisture.

Having thus described the invention, what is claimed is:

1. A method of heating a package of material wherein the material is contained within a closed and sealed packaging structure, the material being capable of generating moisture vapor from a substance contained therein when the temperature of said material is raised, the method comprising the steps of:

(a) enclosing said material in a sealed packaging structure wherein at least a portion of said packaging structure comprises an extensible plastic film, at least a portion of said film having a route devoid of barriers between said film and said material;

(b) configuring said package so that at least a portion of said film is devoid of barriers to displacement of said film away from said material; and (c) applying thermal energy to said material, causing substantial vaporization of said substance, such that said plastic film is displaced by said vapor away from said material, and such that, said film being at least 80% ionomer, after said film is displaced from said material, a vent hole appears at an unselected location in said film for venting said vapor without substantial rupture of said film as a whole.

2. A method as in claim 1 wherein said thermal energy is induced in said material by subjecting said package to microwave energy.

3. A method as in claim 2 wherein said material comprises a food product.

4. A method as in claim 3 wherein said film comprises layers of EVOH, an only divide modified ethylene-based polymer and ionomer, in weight ratios of about 10% EVOH, 10% an anhydride modified ethylene-based polymer and 80% ionomer.

5. A method as in claim 1, 2, or 3 wherein said film is between about 1 mil and 6 mils thick.

6. A method as in claim 5 wherein said film includes a layer of Saran.

7. A method as in claim 1, 2, or 3 wherein said film is between 3 mils and 4.5 mils thick.

8. A method as in claim 7 wherein said film includes a layer of Saran.

9. A method of heating a package of food with microwave energy wherein said food is contained within a closed and sealed packaging structure, said food being capable of generating water vapor from moisture contained therein when the temperature of said food is raised, the method comprising the steps of:

(a) enclosing said food in a sealed packaging structure wherein at least a portion of said packaging structure comprises a plastic film, at least a portion of said film having a route devoid of barriers between said film and said food;

(b) configuring said package so that at least a portion of said film is devoid of barriers to displacement of said film from said material; and (c) applying microwave energy to said food, causing substantial vaporization of said moisture, such that said plastic film is displaced by said moisture vapor away from said food, at least 80% by weight of said film comprising ionomer, said film being between about 3 mils and about 4.5 mils thick, and such that, after said film is displaced by said moisture vapor, a vent hold appears at an unselected location in said film for venting said vapor without substantial rupture of said film as a whole, and said film retains its general displaced configuration after appearance of said vent hole.

* * * * *